US005843629A

United States Patent [19]

Fleury et al.

[11] Patent Number: 5,843,629

[45] Date of Patent: Dec. 1, 1998

[54] METHOD OF TREATING A SEASONED ASCORBIC ACID DEVELOPER

[75] Inventors: Isabelle Fleury, Chalon sur Saone; Philippe Strauel, Givry, both of France

[73] Assignee: Eastman Kodak Company, Rochester, N.Y.

[21] Appl. No.: 915,521

[22] Filed: Aug. 15, 1997

[30] Foreign Application Priority Data

Aug. 21, 1996 [FR] France ..... 96 10456

[51] Int. Cl.[6] ..... G03C 5/31

[52] U.S. Cl. ..... 430/399; 430/398

[58] Field of Search ..... 430/398, 399

[56] References Cited

U.S. PATENT DOCUMENTS

| | | | |
|---|---|---|---|
| 3,253,920 | 5/1966 | Rees et al. | 430/399 |
| 4,163,023 | 7/1979 | Endo et al. | 564/99 |
| 4,606,827 | 8/1986 | Ernstson et al. | 430/399 |
| 4,680,123 | 7/1987 | Wernicke et al. | 430/399 |
| 5,457,214 | 10/1995 | O'Donnell | 549/315 |
| 5,491,048 | 2/1996 | Anderson et al. | 430/399 |

FOREIGN PATENT DOCUMENTS

| | | |
|---|---|---|
| 0 348 532 | 1/1990 | European Pat. Off. . |
| 609940 | 8/1994 | European Pat. Off. . |
| 2654708 | 6/1977 | Germany . |

*Primary Examiner*—Hoa Van Le
*Attorney, Agent, or Firm*—John R. Everett

[57] ABSTRACT

The present invention concerns a method of treating a seasoned ascorbic acid developer for developing silver halide photographic products. The method of the invention comprises the step of treating the developer through a resin having a greater selectivity for bromide ions than for carbonate ions. This method enables ascorbic acid developers to be regenerated efficaciously.

5 Claims, 2 Drawing Sheets

METHOD OF TREATING A SEASONED ASCORBIC ACID DEVELOPER

FIELD OF THE INVENTION

The present invention concerns a method of treating a seasoned ascorbic acid developer, useful to develop silver halide photographic products. In particular, the invention concerns a method of treating the developer by ion exchange through a resin having a particular selectivity.

BACKGROUND

When silver halide photographic products are developed with a photographic developer, the chemical composition of the developer changes over the course of time (consumption of chemical products), thereby necessitating the use of replenishers. These replenishers enable effective concentrations of chemical compounds in the developer to be maintained.

In the course of development, another phenomenon alters the composition of the developer and hence its efficacy. This is because, in the course of the development of silver halide photographic products, the developer contains more and more halide ions coming from the photographic product. When these ions are bromide or iodide ions, they considerably slow down the speed of development of the image.

These developers whose chemical composition has thus changed over time of use are referred-to as "seasoned developers".

Although conventional developers initially contain a certain quantity of bromide, it is important to eliminate the additional bromide or iodide ions released during development. If this were not done, the bromide and/or iodide concentration in the developer would increase continuously, rapidly rendering the developer unusable.

The need of elimination of the bromide and/or iodide ions released in the course of development in color developers with an anion exchange resin in order to eliminate the bromide or iodide ions is already known.

European patent 178,539 describes a method of treating a seasoned developer with an anion exchanger which contains $OH^-$ groups as exchangeable groups.

The article "Developer recycling—A new generation" Meckl, Journal of Imaging Technology, 13, 1987, 3, 85–89, describes a system in which the effluent at the outlet of the development reservoir is poured out into a holding tank, and then passes through an ion exchange resin in order to eliminate the bromide ions. To this effluent from which the bromide ions have been removed, replenishing compounds are added. The replenisher solution thus obtained is re-usable as a developer.

European patent application 609,940 describes a method in which a silver halide seasoned developer is treated to eliminate the seasoning ions and then a quantity of replenishing compounds is added which is sufficiently low not to cause an overflow, the method being characterised in that the seasoned developer is treated with means for continuously eliminating all the bromide ions and maintaining a zero bromide concentration during the processing of the photographic films. According to European patent application 609,940, the bromide ions can be eliminated by means of ion exchange resins. These resins are of the anionic type, strongly basic, the preferred resins being anionic-type resins consisting of a polystyrene matrix cross-linked for example with divinylbenzene, comprising quaternary ammonium groups. The affinity of these resins with respect to bromide, sulfite and sulfate was studied when using it for treating a KODAK C41® color developer. This patent application provides no information as to the performance of the system or the affinity of the resins.

Although these techniques of treating seasoned developers with ion exchange resins are known, it is impossible to choose from amongst the numerous resins available on the market an ion exchange resin which would be particularly suited to the treatment of a particular developer. The specifications of the various resins available on the market generally contain only details of structure or recommendations for a particular application. There exist anionic resins, cationic resins, acrylic resins, styrene resins, cross-linked or otherwise, for example cross-linked by divinylbenzene. These resins can be resins of the gel type which have natural porosity or resins of the macroporous type which are resins to which is added at the time of polymerisation a porogenic substance which forms an artificial porosity within the resin.

Ion exchange resins are generally developed for the treatment of water. The diversity and concentration of the ions in water are not comparable to those of the various ions present in a photographic developer.

Furthermore, there exists a large number of photographic developers, for example color developers, hydroquinone developers, ascorbic acid developers, etc. These developers have complex and highly different chemical compositions, and contain a large number of ionic and organic substances in highly variable quantities. The presence of organic compounds can lead to rapid poisoning of the resin. The poisoned resin is then ineffective for retaining ionic substances, in particular bromide ions.

The selectivity of the resins is highly dependent on the concentration of the different ions contained in the developer to be treated and, when a given developer is to be treated by means of anion exchange resins, there is no information which enables an efficacious resin to be chosen from all those which exist.

We performed test treatments of seasoned ascorbic acid photographic developers with different ion exchange resins. These tests showed that the efficacy of ion exchange resins having a similar theoretical capacity (number of active sites available) was highly variable.

Thus, persons skilled in the art wishing to develop an effective system of treatment for a seasoned ascorbic acid photographic developer have no alternative but to test a large number of anion exchange resins in order to choose the most effective.

SUMMARY OF THE INVENTION

One object of the invention is to provide a method of treating a seasoned ascorbic acid developer which very selectively eliminates bromide and/or iodide ions and does not eliminate the other chemical compounds contained in the developer, which makes it possible to recycle this treated developer for the development of photographic films and thereby reduce the volume of effluent.

Another object of the invention is to provide a rapid method of selecting efficacious anion exchange resins for the treatment of an ascorbic acid developer. In view of the above considerations, it will be understood that it is desirable to be able to identify, in a simple, economical fashion, the ion exchange resins which are useful to treat a seasoned ascorbic acid developer with an improved efficacy, that is to say a resin which enables, for a given volume, a larger volume of seasoned developer to be treated.

The present invention concerns a method of treating a seasoned silver halide photographic developer, the developer containing silver bromide and/or silver iodide, and a developing agent of the ascorbic acid type, said method comprising the step of treating the seasoned developer with an anion exchange resin having an affinity for the bromide ions greater than its affinity for the carbonate ions.

The developer is specificaly intended for developing silver halide photographic materials containing silver bromide and/or silver iodide.

It has been discovered that, surprisingly, some resins have an improved efficacy in eliminating bromide ions in the treatment of ascorbic acid developers and that this improved efficacy is closely linked to the affinity of this resin for the bromide ions in the presence of carbonate ions, even for a carbonate ion concentration which is much greater than the bromide ion concentration.

PREFERRED EMBODIMENTS

Figure 1:
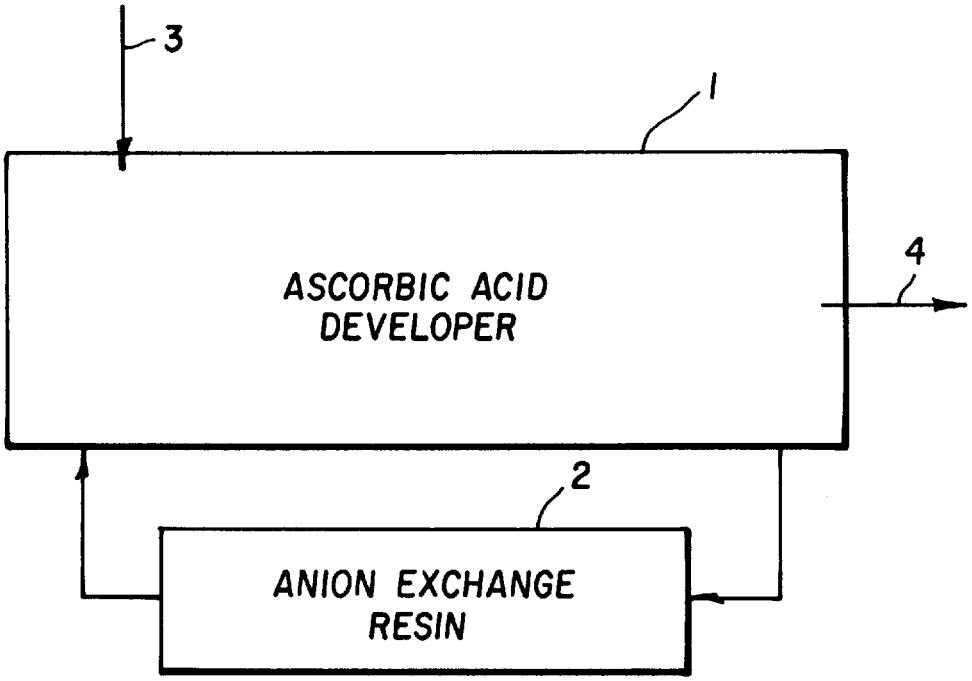
FIG. 1 is a diagrammatic depiction of a particular embodiment of the method of the invention.

In the context of the present invention, "ascorbic acid developer" refers to a developer which contains as its developing agent ascorbic acid and/or a derivative of this acid, for example, L-ascorbic acid, D-isoascorbic acid, D-glucoascorbic acid, 6-desoxy-L-ascorbic acid, or ascorbic acid or derivatives of ascorbic acid in the form of salt, for example sodium ascorbate, sodium erythorbate, etc.

These ascorbic acid developers enable the silver image to be developed, which consists of reducing the exposed silver halide grains into metallic silver. These are developers designed for the development of black and white photographic products, radiographic products or products for graphic art. They can also be used in the black and white development stage of a reversal system.

Ascorbic acid developers can contain other conventional developing agents in a mixture. Conventionally, a synergy effect is observed between the ascorbic acid and the auxiliary developing agent or "codeveloper". This phenomenon, referred to as "superadditivity", is explained in Mason, *"Photographic Processing Chemistry"*, Focal Press, London, 1975.

Amongst the codevelopers most frequently used are aminophenols, such as Elon® (methyl-p-aminophenol sulphate), 1-phenyl-3-pyrazolidones or phenidones, such as phenidone-A(1-phenyl-3 pyrazolidone), phenidone-B(1-phenyl-4 methyl-3-pyrazolidone), dimezone(1-phenyl-4,4'-dimethyl-3-pyrazolidone), dimezone-S(1-phenyl-4-methyl-4'-hydroxymethyl-3-pyrazolidone) and 1-phenyl-4-hydroxymethyl-4'-hydroxymethyl-3-pyrazolidone. Additional representative examples of aminophenols and phenidones are described in U.S. Pats. Nos. 2,688,549, 2,691,589, 3,865,591, 4,269,929, 4,840,879 and 5,236,816, and in the article by G. E. Ficken and B. G. Sanderson, *The Journal of Photographic Science*, Vol.11, 1963, pages 157–164.

Ascorbic acid developers can contain other chemical compounds conventional in photography such as antioxidants, anti-fog agents, antiliming agents or buffer agents for example.

A developer which can be used within the scope of the invention is the ascorbic acid developer described in U.S. Pat. No. 5,474,879 in the name of EASTMAN KODAK or in *Research Disclosure,* 35249, August 1993.

In general, ascorbic acid developers contain an initial quantity of bromide which can be between 2 and 30 g/l. This initial quantity will increase in the course of photographic film processing through the release of bromide ions contained in these films.

In general, ascorbic acid developers initially contain no iodide ions. These iodide ions appear in the developer only during the processing of photographic films containing iodide ions.

According to one embodiment, the seasoned developer is passed through the anion exchange resin, which has an affinity for the bromide ions which is greater than that of the carbonate ions so as to totally eliminate the bromide and/or iodide ions contained in the seasoned developer. At the outlet from the anion exchange resin, the seasoned developer thus treated no longer contains any bromide and/or iodide ions. At the outlet from the anion exchange resin, the treated developer is recycled either discontinuously, that is to say after storage, or continuously in the processing tank.

The method of the invention can be used according to the device in FIG. 1, which comprises a processing tank containing the ascorbic acid developer (1), equipped with a column containing the anion exchange resin, which treats the developer continuously (2), and an inlet for the replenisher (3) and an effluent outlet (4).

According to a particular embodiment, the anion exchange resin having an affinity for the bromide ions greater than that of the carbonate ions is a strongly basic polystyrene resin with a macroporous structure containing alkyl quaternary ammonium groups having alkyl comprising from 1 to 4 carbon atoms.

According to particular embodiments, the anion exchange resin is chosen from amongst the IMAC HP 555® resin manufactured by Rohm & Haas®, the A520 E® resin manufactured by Purolite International®, the IRA 900C® resin manufactured by Rohm & Haas® and the IRA 420® resin manufactured by Rohm & Haas®.

The resin, when it no longer retains the bromide and/or iodide ions satisfactorily, is regenerated by means of concentrated saline solutions in order to render it reusable for the treatment of the seasoned developer. The regeneration can be performed with flow in the same direction as or in the opposite direction to the passage of the seasoned developer. According to a particular embodiment, the regeneration is performed with flow in the opposite direction by passing a sodium chloride solution or a mixture of sodium chloride and sodium hydroxide, and then a solution of sodium hydroxide, in order to desorb chloride ions.

Conventionally, a method of treating a black and white photographic product contains a step of silver development, a fixing step and one or more washing steps.

In the context of the invention, the silver development takes place with an ascorbic acid developer.

The fixing bath completely transforms the silver halides into water-soluble silver complexes which are then eliminated from the layers of the photographic product by washing. The compounds used for fixing are described in paragraph XX B of *Research Disclosure*, September 1994, No 36544, referred to in the remainder of the description as *Research Disclosure*, for example thiosulphates such as ammonium or alkali metal thiosulphate.

The photographic product of the present invention comprises a support covered on at least one of its faces with a layer of silver halide emulsions which contains bromide and/or iodide ions in the form of silver halides. The photographic product of the invention can contain other halides, for example chlorides, chlorobromides, bromochlorides, chloroiodides, bromoiodides and bromochloroiodides.

Silver halide emulsions consist of a hydrophilic colloidal binder, generally gelatine, in which silver halide grains are dispersed.

The silver halide grains can be chemically sensitised as described in *Research Disclosure*, Section IV. They can be chromatised by spectral sensitising dyes, as described in *Research Disclosure*, Section V.

The silver halide grains can have different morphologies (see Section 1-B of *Research Disclosure*).

The photographic product can contain other photographically useful compounds, for example coating aids, stabilisers, plasticisers, anti-fog agents, tanning agents, antistatic agents, matting agents, etc. Examples of these compounds are described in *Research Disclosure*, Sections VI, VII, VIII, X.

The supports which can be used in photography are described in Section XV of *Research Disclosure*; Section XV. These supports are generally polymer supports such as cellulosic, polystyrene, polyamide, polyvinyl, polyethylene or polyester polymers, or paper or metal supports.

The photographic products can contain other layers, for example a protective top layer, intermediate layers, an antihalation layer, an antistatic layer, etc. These different layers and their arrangements are described in Section XI of *Research Disclosure.*

According to one embodiment of the invention, the photographic products which are processed are radiographic products which comprise a support coated on each of its faces with a silver halide emulsion and a protective layer. The emulsions are generally emulsions essentially containing silver bromide.

The present invention is illustrated by the following examples.

EXAMPLES

Example 1

Seasoning of the bath

In the following examples, T-MAT G/RA® radiographic films, manufactured by EASTMAN KODAK®, were used. These products were exposed directly to X-rays so as to obtain a density of 1.2. Following exposure, these products were developed according to the processing cycle used in a KODAK 480RA® processing machine, which comprises a step of development with the developer described above (25 secs, 35° C.), a fixing step (20 secs, 35° C.), a washing step (15 secs, 20° C.) and a drying step (25 secs, 55° C.).

| Composition of the ascorbic acid developer | |
|---|---|
| Ascorbic acid | 32 g/l |
| 4-hydroxymiethyl-4-methyl-1-phenyl-3-pyrazolidone | 2.5 g/l |
| Benzotriazole | 0.2 g/l |
| $K_2CO_3$ | 100 g/l |
| $K_2SO_3$ | 50 g/l |
| Diethylenetriamine-pentacetic acid (40% sol) | 4.3 g/l |
| KBr | 4 g/l |

400 T-MAT G/RA® film plates (60 $m^2$) exposed according to the above method were processed continuously with the ascorbic acid developer described above in order to obtain a seasoned developer. The developer was thus enriched with the bromide ions from the films developed. The processing of the films was then made with the addition of a replenisher to the seasoned developer so as to keep its chemical composition constant.

Treatment of the developer

The overflow from the tank of developer (seasoned developer enriched with bromide) was treated through an anion exchange resin so as to eliminate the bromide ions. To this end, the seasoned developer was passed through a column containing 20 ml of anion exchange resin.

These resins were identified in Table 1 below. A certain volume of developer was thus treated until bromide ions appear at the outlet from the column (pierced face).

Analysis of the quantity of bromide ions in the solution leaving the column was performed by ionic chromatography.

Figure 2:
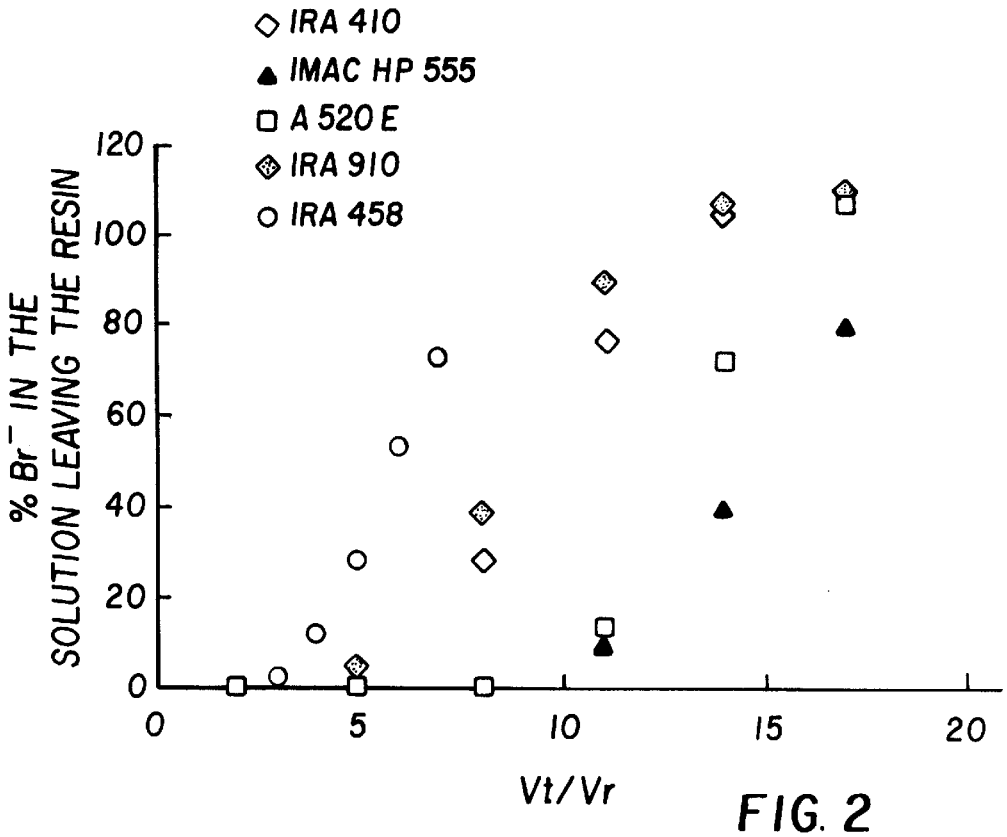
FIG. 2 is a curve showing the volume of seasoned ascorbic acid developer which can be treated by the resins of the invention and comparative resins.

FIG. 2 depicts the percentage of bromide ions contained in the developer at the outlet from the column compared with the initial bromide concentration of the seasoned developer, according to the volume of seasoned developer which has passed through the column containing the anion exchange resin (expressed as volume of developer treated Vt/apparent volume of resin Vr).

This curve shows the volume of seasoned developer which can be treated until bromide ions appear at the outlet from the column. This treated volume is representative of the efficacy of the anion exchange resin used.

TABLE 1

| | Characteristics of the resin | | |
|---|---|---|---|
| Resin | Copolymer crosslinked by divinylbenzene | Matrix | Total capacity (eq/l) |
| IRA 458 ® ❶ | Acrylic | Gel | 1.25 |
| IMAC HP555 ® ❶ | Styrenic | Macroporous | 0.9 |
| IRA 410 ® ❶ | Styrenic | Gel | 1.3 |
| IRA 910 ® ❶ | Styrenic | Macroporous | 1.05 |
| A 520 E ® ❷ | Styrenic | Macroporous | 1 |

❶ manufactured by ROHM & HAAS
❷ manufactured by PUROLITE

The curve in FIG. 2 shows that the IMAC HP555® and A 520 E ® resins are capable of treating a larger volume of seasoned developer.

Example 2

Regeneration of the resin.

When the IMAC HP 555® resin described above no longer retained the bromide ions sufficiently, the resin was regenerated by passing the following solutions in counter-flow:

NaCl, 2M, 20 ml (quantity equal to the volume of resin to be regenerated)

NaCl, 2M–NaOH, O, 5M, 140 ml (7 times the volume of resin to be regenerated)

NaOH, O, 5M, 100 ml (5 times the volume of resin to be regenerated)

$H_2O$ 40 ml

Through this treatment of the resin, over 90% desorption of the bromide ions was achieved. The efficacy of this desorption enables a seasoned developer containing bromide ions to be treated with the same resin over 25 times without a significant increase in the concentration of bromide ions being observed in the developer following treatment.

Example 3

In this example, the resins previously described were tested with:

① a solution containing only bromide ions (potassium bromide 4 g/l);

② a solution containing a mixture of bromide ions (potassium bromide 4 g/l) and carbonate ions (potassium carbonate 100 g/l), the proportions of bromide ions and carbonate ions being identical to those of the ascorbic acid developer in Example 1.

For each experiment, the quantity of bromide adsorbed per gram of resin, in the presence or absence of carbonate ions, was measured.

The results are set out in Table 2 below.

TABLE 2

| Resin | Sol. ① (g. $Br^-$/g. resin) | Sol. ② (g. $Br^-$/g. resin) |
|---|---|---|
| IRA 458 ®❶ | 0.036 | 0.024 |
| IMAC HP 555 ®❶ | 0.038 | 0.036 |
| IRA 410 ®❶ | 0.037 | 0.028 |
| IRA 910 ®❶ | 0.036 | 0.027 |
| A 520 E ®❷ | 0.037 | 0.035 |

These results show that with solution ① the adsorption of bromide ions in the absence of carbonate ions is similar, whatever the resin, whereas with solution ② the adsorption of the bromide ions decreases in the presence of carbonate ions and depends on the resin used.

These results show clearly that the capacity of a resin to treat a seasoned ascorbic acid developer effectively depends on the ability of the resin to adsorb bromide ions preferentially with respect to carbonate ions.

It is possible, using simplified solutions containing bromide ions and carbonate ions, to rapidly determine and classify which resins will be particularly efficacious for the treatment of a seasoned ascorbic acid developer to eliminate bromide ions.

Figure 3:
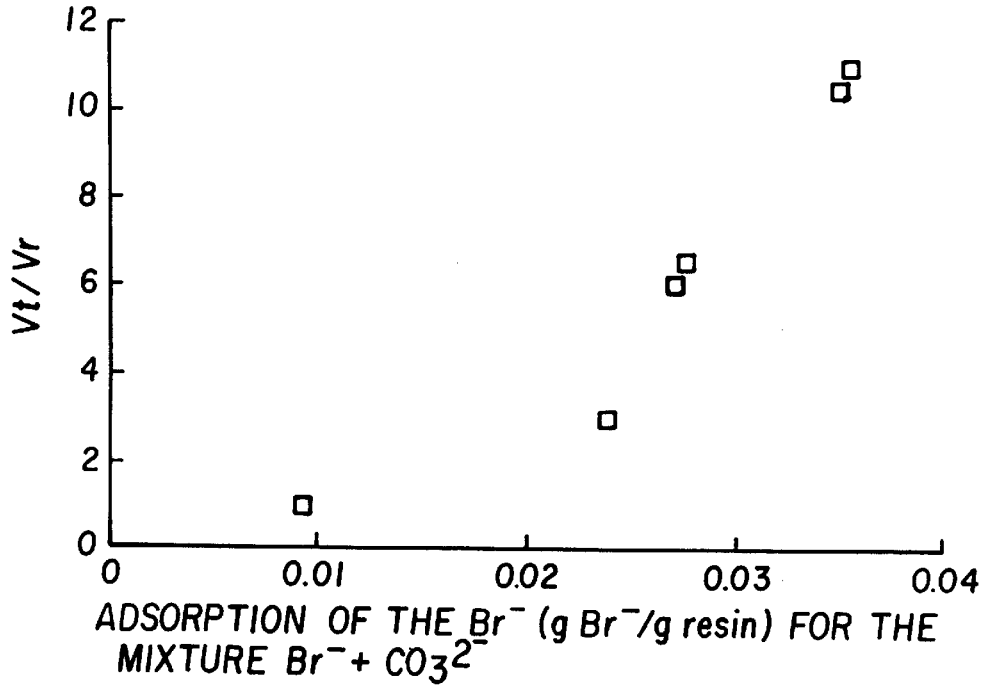
FIG. 3 illustrates the efficacy of the resins of the present invention for the treatment of ascorbic acid developers seasoned by bromide ions.

FIG. 3 depicts a curve illustrating the volume of seasoned developer which can be treated for a concentration of bromide in the treated solution below 0.2 g/l depending on the capacity of the resin to adsorb bromide ions selectively with respect to carbonate ions. This curve shows that, surprisingly, the volume of ascorbic acid developer treated by the resin will be greater, the higher the bromide/carbonate selectivity.

We claim:

1. Method of treating a seasoned photographic silver halide developer, said seasoned developer containing silver bromide a developing agent of the ascorbic acid type, said method comprising the step of treating the seasoned developer with an anion exchange resin having an affinity for the bromide ions greater than its affinity for carbonate ions.

2. The method of claim 1, wherein the seasoned developer also contains iodide ions.

3. The method of claim 2, wherein the quantity of bromide ions is greater than the quantity of iodide ions.

4. The method of to claim 1, wherein the anion exchange resin is a resin of the macroporous type, with a crosslinked styrene matrix, containing alkyl ammonium where alkyl groups have from 1 to 4 carbon atoms.

5. The method of claim 1, which comprises further the step of regenerating the anion exchange resin by treating said resin successively, (i) with at least one solution containing a mixture of chloride ions and hydroxide ions, and (ii) with a solution containing anions capable of desorbing the chloride ions.

* * * * *